US005845406A

United States Patent [19]

Lüttgens

[11] Patent Number: 5,845,406

[45] Date of Patent: Dec. 8, 1998

[54] SOFT CORE PENCIL SHARPENER INCLUDING CLEANING SHAPER

[75] Inventor: Fritz Lüttgens, Erlangen, Germany

[73] Assignee: KUM GmbH & Co. KG Kunststoff- und Metallwarenfabrik, Erlangen, Germany

[21] Appl. No.: 961,232

[22] Filed: Oct. 30, 1997

[30] Foreign Application Priority Data

| | | | |
|---|---|---|---|
| Jun. 5, 1997 | [DE] | Germany | 197 23 541.7 |
| Jun. 27, 1997 | [EP] | European Pat. Off. | 97 110 532 |

[51] Int. Cl.[6] ..... B43L 23/00

[52] U.S. Cl. ..... 30/454; 30/451; 144/28.11

[58] Field of Search ..... 30/454, 462, 451; 144/28.1, 28.11

[56] References Cited

U.S. PATENT DOCUMENTS

| | | | |
|---|---|---|---|
| 2,309,194 | 1/1943 | Hutchinson | 30/462 |
| 4,248,283 | 2/1981 | Kaye | 30/454 |
| 4,513,798 | 4/1985 | Luttgens | 144/28.11 |

FOREIGN PATENT DOCUMENTS

| | | |
|---|---|---|
| 518075 | 2/1931 | Germany . |
| 1 236 374 | 3/1967 | Germany . |
| 30 04 020 | 8/1981 | Germany . |
| 31 45 536 | 5/1983 | Germany . |
| 91 04 737 | 10/1991 | Germany . |

*Primary Examiner*—Hwei-Slu Payer
*Attorney, Agent, or Firm*—Venable; Gabor J. Kelemen

[57] ABSTRACT

A sharpener for a soft core pencil having a pencil end to be sharpened, the pencil end including a free core end, the sharpener comprising a housing defining: a guide conduit therein for receiving the pencil end to be sharpened; and a hollow space adjacent to and in communication with the guide conduit for surrounding the free core end of the pencil during sharpening thereof. The sharpener further includes a cutting blade received by the housing approximately tangentially with respect to the guide conduit and to the hollow space for cutting the end of the pencil; and a cleaning shaper supported by the housing, the cleaning shaper having a secured position and a removed mode relative to the housing and including: a core shaper protruding into the hollow space in the secured position of the cleaning shaper for shaping the free core end of the pencil during sharpening; a cleaning device connected to the core shaper and introducible into the hollow space in the removed mode of the cleaning shaper for cleaning core mass accumulated in the hollow space during sharpening; and an arrangement for supporting the cleaning device for holding the cleaning shaper in its secured position.

14 Claims, 2 Drawing Sheets

SOFT CORE PENCIL SHARPENER INCLUDING CLEANING SHAPER

CROSS REFERENCE TO RELATED APPLICATION

This application claims the priority of application number 197 23 541.7 filed in Germany on Jun. 5, 1997, and of European application number 97 110 532.5 filed on Jun. 27, 1997, the subject matter of both of which is incorporated herein by reference.

FIELD OF THE INVENTION

The invention relates to a sharpener for soft core pencils, particularly for cosmetic pencils, which comprises a housing defining a guide conduit therein for receiving the pencil end to be sharpened and a hollow space adjacent to and in communication with the guide conduit for surrounding the free core end of the pencil during sharpening thereof. The sharpener further includes a cutting blade received by the housing approximately tangentially with respect to the guide conduit and to the hollow space for cutting the free core end of the pencil, and a core shaper adapted to protrude into the hollow space for shaping the free core end of the pencil during sharpening.

BACKGROUND OF THE INVENTION

DE-C 1 236 374 discloses a known soft core pencil of the aforementioned type, in which the core shaper configured as a generatrix for the core tip of the pencil is permanently fixed to the sharpener housing. In the immediate vicinity of the core shaper, pasty, sticky pieces of core material are removed from the end of the core on the pencil by being, for example, shaved or trimmed off. Because of its sticky or pasty consistency, the mass of core material tends to become jammed in the vicinity of the core shaper. Thus, in sharpeners of the above kind, the housing space accommodating the core shaper is kept particularly large for receiving a larger volume of shaved soft-core mass without jamming or other difficulties. A jam of soft-core material tends to cause undesired smearing which, especially in cosmetic pencils, is disadvantageous and counter to the purpose of cosmetics use.

In order to remove the shaved-off soft-core mass, the sharpener is equipped according to the prior art with an additional cleaning rodlet, as disclosed for example in DE-C-30 04 020 at FIGS. 8 and 9. The sharpener housing is provided with a means of holding the cleaning rodlet in order to keep the same from getting lost. During storage and use of the sharpener, the cleaning rodlet is held in its secured position on the sharpener housing, only its handle end protruding therefrom. After a sharpening procedure has been performed, the cleaning rodlet may be removed from its secured position for cleaning the housing space accommodating the end of the pencil. The cleaning end of the rodlet disposed opposite its handle end is dimensioned such that it can penetrate the hollow space of the housing that surrounds the free core end of the pencil during the sharpening procedure and remove the collected soft-core material directly therefrom. The cleaning rodlet is made of plastic, and can therefore remove the soft-core material jammed in the region of the sharpening blade without damaging the blade.

In the above sharpener, the cleaning rodlet includes an integral core shaper, that is, the core shaper and the rest of the rodlet form a one-piece component. In devices of the prior art, however, the core shaper impairs access to the hollow space on the sharpener housing surrounding the free core end of the pencil during sharpening at exactly the location where the soft-core mass of material to be removed accumulates.

SUMMARY OF THE INVENTION

It is an object of the invention to overcome the disadvantage associated with the prior art by providing a sharpener which eliminates the impairment of accessibility to the hollow space on the sharpener housing surrounding the free core end of the pencil during sharpening for allowing the soft-core mass of material accumulating therein to be cleaned.

The above object, together with other objects to become apparent as the description progresses, are accomplished according to the invention by the provision of a sharpener for a soft core pencil having a pencil end to be sharpened, the pencil end including a free core end, the sharpener comprising a housing defining: a guide conduit therein for receiving the pencil end to be sharpened; and a hollow space adjacent to and in communication with the guide conduit for surrounding the free core end of the pencil during sharpening thereof. The sharpener further includes a cutting blade received by the housing approximately tangentially with respect to the guide conduit and to the hollow space for cutting the end of the pencil; and a cleaning shaper supported by the housing and having a secured position and a removed mode relative to the housing, the cleaning shaper including: a core shaper protruding into the hollow space in the secured position of the cleaning shaper for shaping the free core end of the pencil during sharpening; a cleaning device connected to the core shaper, the cleaning device being introducible into the hollow space in the removed mode of the cleaning shaper for cleaning core mass accumulated in the hollow space during sharpening; and means for supporting the cleaning device for holding the cleaning shaper in the secured position thereof.

According to the invention, the core shaper and a cleaning device together form a cleaning shaper. During storage and use of the sharpener, the core shaper is configured to assume a functional position on the housing which allows it to shape the free core end of the pencil. In order to subsequently clean the hollow space on the sharpener housing, the core shaper and the cleaning device, which may be shaped together as a cleaning rodlet as set forth above, are released from their functional, secured position, which tends to impair accessibility to the hollow space on the sharpener housing. Combining a core shaper and a cleaning device to form a cleaning shaper according to the invention additionally solves the problem of securing the core shaper at a predetermined location after its release from its functional position on the housing. Following use and cleaning of the sharpener, the cleaning shaper may be returned to its secured position by the housing such that its core shaper assumes its functional position suitable for shaping the free core end of the pencil.

The cleaning shaper may advantageously be a one-piece, molded plastic part which may be manufactured in a simple manner, and, because of its relatively small size, it may be produced economically from high-grade plastics. Accordingly, it is additionally possible to provide, at a low cost, a surface coating on the cleaning shaper which either counteracts a sticking of the soft-core mass to the cleaning shaper or which improves a shaping effect of the core shaper thus improving a formation of shavings from the core. This surface coating may be provided on either the entire cleaning shaper or, owing to improved accessibility to the hollow space on the sharpener housing surrounding the free core end of the pencil during sharpening, only the core shaper part of the cleaning shaper. Additionally, the small size of any given cleaning shaper makes it possible to keep available various cleaning shapers whose geometries differ from that of their core shaper parts, as a function, for example, of the different degrees of pencil core softness anticipated.

The cleaning shaper is securely and removably held by the housing by a frictional connection therewith. The insertion direction of the cleaning shaper into its holding or secured position on the housing can vary as a function of the requirements for shaping the core on the pencil.

The cleaning shaper can be inserted in the direction of its longitudinal axis into a quiver-type receiving conduit in the housing. Alternatively, the cleaning shaper may be inserted into a groove on an outside wall of the housing in a direction transverse to its longitudinal axis. It is particularly advantageous if the core shaper part of the cleaning shaper can be fed, when the cleaning shaper is in its secured position, toward the guide conduit of the sharpener or toward the hollow space on the sharpener housing surrounding the free core end of the pencil during sharpening. The above may be accomplished in a simple manner by a continuous frictional holding of the cleaning shaper. In the above arrangement, the core shaper part of the cleaning shaper may be adjusted to assume a guide function with respect to the core of the pencil, thus acting as a generatrix for an intended shape of the core. The core shaper may, for example, surround the core point of the pencil in the manner of an enveloping hood. A guiding function such as the one described above is particularly advantageous in certain types of cosmetic pencils, especially those possessing relatively soft cores.

Many cosmetic pencils are produced by pouring the core, usually in a heated state, while the core is still in liquid form, into the shavable enveloping casing of the pencil, which casing can be made for example from wood. The core mass subsequently hardens during a cooling process. The above causes the core to shrink, leading to the formation of a small gap between the core and the enveloping casing thereof. As a result, the core is not completely fixed in its casing, and cannot be guided by the guide conduit of the sharpener in which the pencil is disposed. However, with a core shaper disposed permanently on the sharpener housing, a lateral deviation pressure is often exerted on the core by the core shaper during sharpening. This deviation pressure generates a bending force that, together with the shearing forces of the core shaper, leads to over-stressing of the core, the core not being structurally secure in the first instance due to its soft consistency as set forth above. Thus, the core is apt to be easily shorn off during the sharpening procedure.

The above effect may be compensated for in particular by the disposition of the cleaning shaper in its secured position such that its core shaper is automatically positioned with respect to the core after the pencil is aligned inside the guide conduit of the housing. For the above purpose, a floating guidance of the core shaper with respect to the core may be provided according to the invention, by means of which the core shaper is automatically aligned with respect to the core in the housing. The above can be effected simply by a corresponding dimensioning of a holding means to fit the cleaning shaper on the housing, the floating means including a sheath seated on the housing to pivot in a feed direction toward the guide conduit for removably inserting and securing the cleaning device therein, the pivotable sheath providing a floating guidance of the cleaning shaper and of its core shaper. According to the above, the cleaning device can be inserted by its cleaning end into the sheath in a feed plane in the direction of the axis of the guide conduit. Subsequently, the cleaning shaper may be pivoted into its functional, secured position, the core shaper automatically adjusting itself, by virtue of the pivoting connection of the sheath to the housing, with respect to the pencil core to be shaped.

The sharpener housing may further be made of metal, thus facilitating the removal of shavings.

BRIEF DESCRIPTION OF THE DRAWINGS

The foregoing objects of the invention, together with other objects and advantages which may be attained by its use, will become more apparent upon reading the following detailed description of the invention taken in conjunction with the drawings. In the drawings, where like reference numerals identify corresponding components.

DETAILED DESCRIPTION OF THE INVENTION

Figure 1:
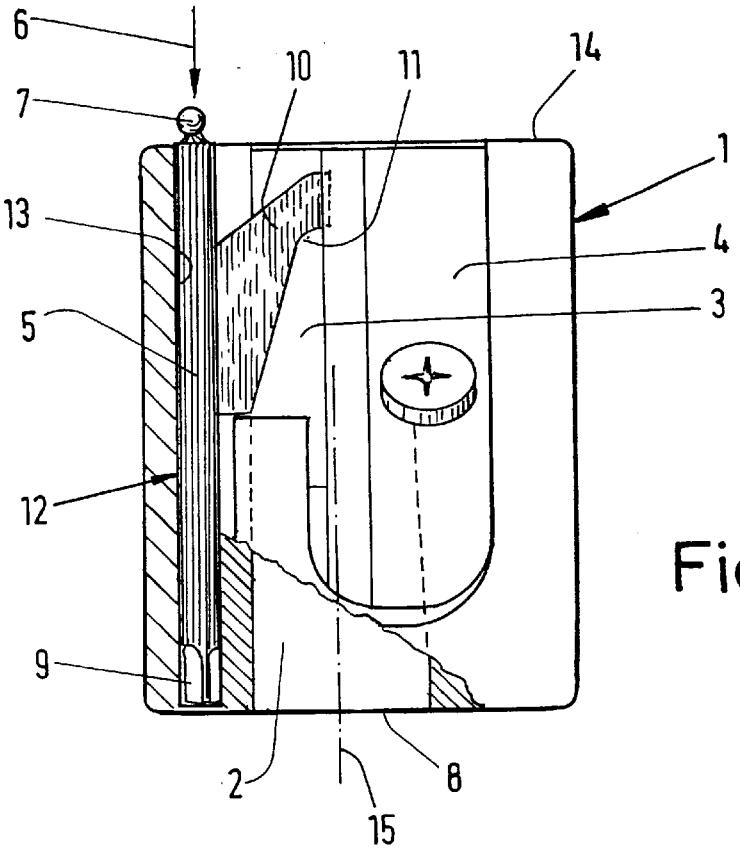
FIG. 1 shows a top plan and partially sectional view of a sharpener according to the invention, in which the cleaning shaper is in its secured position for shaping the pencil core.

As seen in FIG. 1, the sharpener according to the instant invention essentially comprises a housing 1 defining a guide conduit 2 for the pencil end to be sharpened. A hollow space 3 at a front region of guide conduit 2 is adapted to surround the free core end of the pencil end to be sharpened. A sharpening blade 4 is positioned tangentially to guide conduit 2, the blade further being configured to cut the casing for the core, such as the wooden casing of a soft core pencil.

A cleaning device 5 configured as a rodlet, or small rod, is removably held against housing 1 and is inserted in the insertion direction 6 into its secured position on the housing, which housing holds the cleaning device in the manner of a quiver. In the secured position of cleaning device 5 as depicted in FIG. 1, a handle end 7 of the cleaning device which comprises an easy-to-grip knob, projects from housing 1 opposite a termination side of guide conduit 2.

Cleaning device 5, which has an essentially cylindrical shaft, is configured to be pointed at its cleaning end 9 opposite handle end 7 in order to clean more effectively.

At its flank, cleaning device 5 is provided with a core shaper 10. Core shaper 10 is configured as a rib having a shaping edge 11 which serves as a shaving edge adapted or adaptable to the desired shape of the core end to be shaped. Thus, the contour of shaping edge 11 may be varied, for instance by providing different shaving geometries adapted to the respective soft-core consistency of the pencil to be sharpened. Core shaper 10 is disposed on cleaning device 5 such that, in the secured position of the cleaning shaper as shown in FIG. 1 opposite housing space 3, it assumes its desired functional position for shaping the core of the pencil.

The combination of cleaning device 5 with core shaper 10 forms a cleaning shaper 12, which may be a one-piece, molded plastic part. A surface coating may be provided on the cleaning shaper 12 which either counteracts the sticking effect of the soft-core mass on the cleaning shaper or which improves the formation of shavings, or the scraping effect. This surface coating may be provided on either the entire cleaning shaper or, owing to improved accessibility to the hollow space 3 on the sharpener housing surrounding the free core end of the pencil during sharpening, only the core shaper part of the cleaning shaper.

The secure, but removable connection of cleaning shaper 12 on housing 1 may be effected by a frictional connection.

In the embodiment of FIG. 1, this frictional connection is a plug-in connection, where housing 1 includes a quiver-type receiving conduit 13. Receiving conduit 13 starts at a housing side 14 opposite termination side 8 of guide conduit 2, and extends approximately parallel to the longitudinal axis 15 of guide conduit 2.

Figure 2:
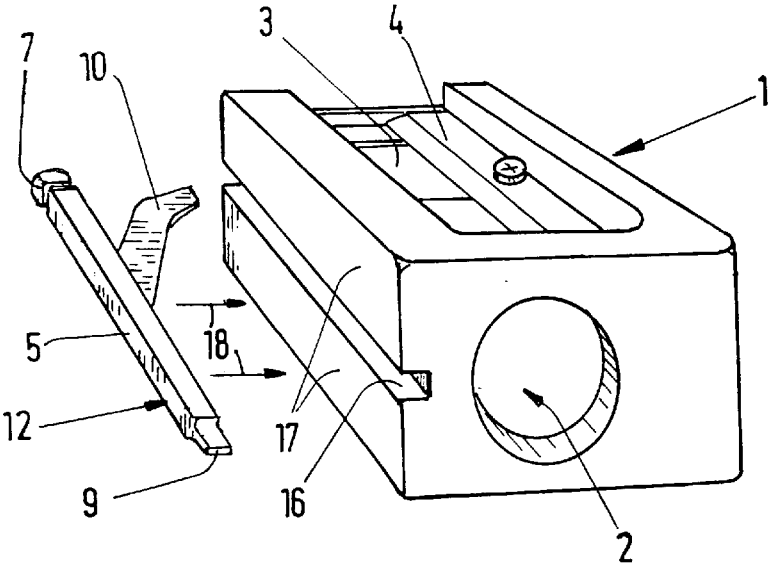
FIG. 2 shows a perspective view of a modified embodiment of the sharpener according to the invention, in which the cleaning shaper is removed from its secured position.

In the embodiment of FIG. 2, cleaning shaper 12 may be fixed in a groove 16 extending approximately parallel to longitudinal axis 15 of guide conduit 2 on outside housing wall 17. Groove 16 is positioned in the housing wall 17 opposite the edge of cutting blade 4.

In its frictional, secure position on housing 1, cleaning shaper 12 may be fed in the direction toward hollow space 3, which, in FIG. 2, corresponds to arrow direction 18 pointing toward guide conduit 2, and, in FIG. 1, is in the plane of the partial cross section of the sharpener as shown in FIG. 1. In the secure position of the cleaning shaper, the frictional connection is effective between cleaning shaper 12 and housing 1.

In the embodiment of FIG. 2, in which the groove holds cleaning device 5, the cross-sectional shape of the shaft of the cleaning device, that is, of cleaning shaper 12, may be rectangular or approximately square.

Figure 3:
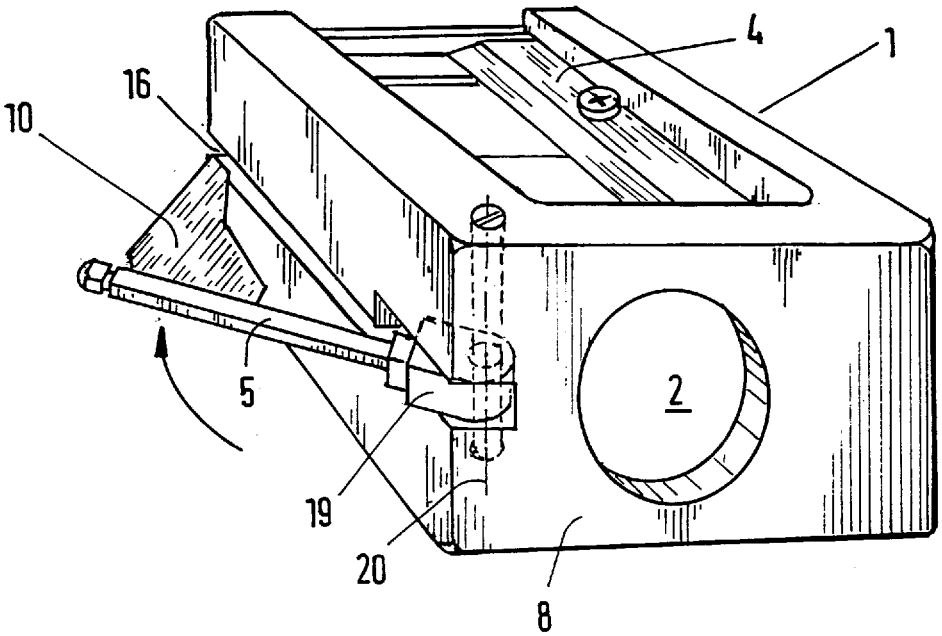
FIG. 3 shows a perspective view of another modified embodiment of the sharpener according to the invention, in which the cleaning shaper is insertable into a pivoting sheath.
Figure 4:
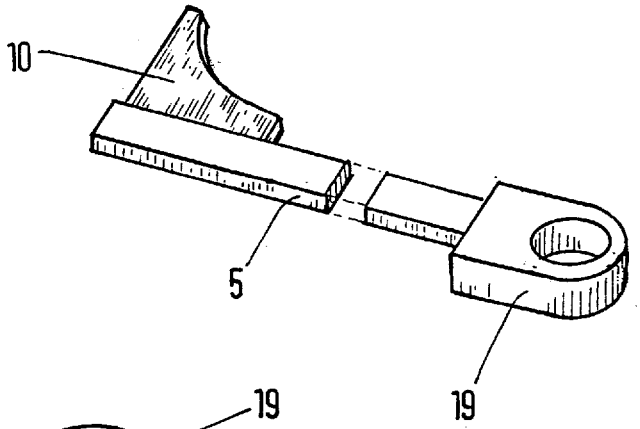
FIG. 4 shows a perspective, exploded view of the cleaning shaper and sheath of FIG. 3.
Figure 5:
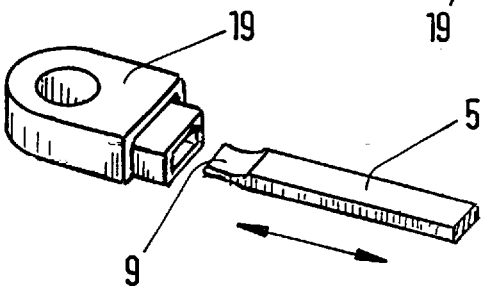
FIG. 5 shows a perspective, exploded view of the sheath and of part of the cleaning shaper of FIG. 3.

FIG. 3 shows a special embodiment of a floating secured position of cleaning shaper 5, in which the shaper may be, on the one hand, inserted into and fixed to housing 1, and, on the other hand, removable from housing 1. In order to effect the above, a receiving sheath 19 is pivotably seated about a pivoting axis 20 at the end of groove 16 facing the termination side of guide conduit 2 for the insertion and securing of the cleaning device into the housing. The pivoting of sheath 19 is effected in a plane which includes the longitudinal axis of guide conduit 2, that is, the feed plane toward guide conduit 2. Because of its pivotable seating, sheath 19 can be pivoted outwardly together with the inserted cleaning device 5 such that cleaning device 5 can be removed even more easily from its inserted, fixed position in sheath 19. The above arrangement provides a somewhat more structurally complicated embodiment of a floating guidance of cleaning device 5 in housing groove 16. This embodiment may additionally be implemented in the structurally simpler form of the invention shown in FIG. 2 for an automatic adaptation of core shaper 10 to the pencil core guided in guide conduit 2.

The invention now being fully described, it will be apparent to one of ordinary skill in the art that any changes and modifications can be made thereto without departing from the spirit or scope of the invention as set forth in the appended claims.

I claim:

1. A sharpener for a soft core pencil having a pencil end to be sharpened, the pencil end including a free core end, the sharpener comprising:

a housing defining:

a guide conduit therein for receiving the pencil end to be sharpened; and a hollow space adjacent to and in communication with the guide conduit for surrounding the free core end of the pencil during sharpening thereof;

a cutting blade received by the housing approximately tangentially with respect to the guide conduit and to the hollow space for cutting the pencil end; and a cleaning shaper supported by the housing and having a secured position and a removed mode relative to the housing, the cleaning shaper including:

a core shaper protruding into the hollow space in the secured position of the cleaning shaper for shaping the free core end of the pencil during sharpening;

a cleaning device connected to the core shaper, the cleaning device being introducible into the hollow space in the removed mode of the cleaning shaper for cleaning core mass accumulated in the hollow space during sharpening; and means for supporting the cleaning device for holding the cleaning shaper in the secured position thereof.

2. The sharpener according to claim 1, wherein the cleaning shaper is a one-piece molded plastic part.

3. The sharpener according to claim 1, wherein:

the core shaper includes a shaving-removal surface thereon; and at least one of the core shaper and its shaving-removal surface include a surface coating thereon.

4. The sharpener according to claim 3, wherein the surface coating is adapted to at least one of counteract a sticking of core to the cleaning shaper and improve a shaping effect of the core shaper.

5. The sharpener according to claim 1 wherein:

the cleaning device includes a flank; and the core shaper is formed onto the flank of the cleaning device and projects radially therefrom in a wing-like manner.

6. The sharpener according to claim 1, wherein the cleaning shaper is held securely by the housing at least one of frictionally and form-fittingly.

7. The sharpener according to claim 6, wherein the cleaning shaper is matingly held by the housing by being plugged therein in a longitudinal direction of the cleaning device.

8. The sharpener according to claim 7, wherein:

the guide conduit extends across the housing; and the housing defines a receiving conduit for receiving the cleaning shaper therein which extends from one side of the guide conduit in a direction of a longitudinal axis of the guide conduit.

9. The sharpener according to claim 1, wherein the housing includes an outside wall defining a groove therein extending approximately parallel to a longitudinal axis of the guide conduit, the cleaning shaper being configured for being removably inserted in the groove for being held by the housing in its secured position.

10. The sharpener according to claim 9, wherein the groove has a cross section in a plane perpendicular to the longitudinal axis of the guide conduit shaped as a segment of a circular arc.

11. The sharpener according to claim 9, wherein the groove is disposed opposite the cutting blade.

12. The sharpener according to claim 11, further comprising a sheath pivotally disposed on the housing and pivotable toward and away from the guide conduit, the sheath being configured for removably receiving and securing the cleaning device therein and for effecting an automatic positioning of the core shaper with respect to the core end when the pencil end is aligned inside the guide conduit.

13. The sharpener according to claim 1, wherein the cleaning shaper is configured such that when it is held in its secured position on the housing, a portion thereof extends toward at least one of the hollow space and the guide conduit.

14. The sharpener according to claim 13, wherein the cleaning shaper is configured such that when it is held in its secured position on the housing, the core shaper thereof is adapted to be automatically positioned with respect to the core end when the pencil end is aligned inside the guide conduit.

* * * * *